US005647232A

United States Patent [19]

Böldt et al.

[11] Patent Number: 5,647,232

[45] Date of Patent: Jul. 15, 1997

[54] AUTOMATICALLY CONTROLLED WASHING MACHINE

[75] Inventors: Frank Böldt; Ingo Schulze, both of Berlin; Harald Moschütz, Grossbeeren; Marianne Röhl, Berlin, all of Germany

[73] Assignee: Bosch-Siemens Hausgeraete GmbH, Munich, Germany

[21] Appl. No.: 629,218

[22] Filed: Apr. 8, 1996

Related U.S. Application Data

[63] Continuation-in-part of Ser. No. 353,614, Dec. 12, 1994, abandoned.

[30] Foreign Application Priority Data

Dec. 10, 1993 [DE] Germany ..... 43 42 274.8

[51] Int. Cl.[6] ..... D06F 33/02

[52] U.S. Cl. ..... 68/12.02; 68/12.12

[58] Field of Search ..... 68/12.02, 12.12, 68/12.14

[56] References Cited

U.S. PATENT DOCUMENTS 4,410,329 10/1983 Blevins et al. ..... 68/12.12 X

FOREIGN PATENT DOCUMENTS 3828039 2/1990 Germany ..... 68/12.14

*Primary Examiner*—Philip R. Coe

*Attorney, Agent, or Firm*—Herbert L. Lerner; Laurence A. Greenberg

[57] ABSTRACT

An automatically controlled washing machine includes a laundry drum and a drive motor which drives the laundry drum at a plurality of different speeds for washing, rinsing and spinning. The speed of the drive motor is adjustable with an rpm control circuit and is determinable in accordance with set-point and actual rpm values. A control circuit of the washing machine can receive a signal during a spin cycle, which is a measure for an undesired braking of the drum (for instance from suds production) and is determined by a mutual ratio of the following operating parameters of the drive motor: the set-point rpm, the actual rpm, and a load-dependent electrical variable, such as a motor current.

10 Claims, 4 Drawing Sheets

AUTOMATICALLY CONTROLLED WASHING MACHINE

CROSS-REFERENCE TO RELATED APPLICATION

This application is a continuation-in-part of application Ser. No. 08/353,614, filed Dec. 12, 1994, and now abandoned.

BACKGROUND OF THE INVENTION

Field of the Invention

The invention relates to an automatically controlled washing machine with a drive motor for driving a laundry drum with a plurality of different speeds for washing, rinsing and spinning, the angular velocity (rpm) of the drive motor being adjustable with an rpm control circuit on the basis of a phase angle control and being determinable in accordance with set-point and actual rpm values.

In order to determine the presence of suds in such a washing machine, which is known from German published, non-prosecuted application DE 36 38 498 A1, the pressure in the so-called pan of the washing machine is measured by a pressure sensor that is known for determining the level, and a conclusion can be drawn therefrom as to the presence or absence of suds. However, it has been found that pressure surges which have an influence on the part of the water and detergent pump on the residual water still present in the pan mistakenly indicate such a high level of water and detergent in the tub that a spin cycle can in no way be allowed and would cause a disruption in spinning. That type of suds detection is therefore uncertain. Moreover, the simultaneous use of the pressure transducer for detecting the water level and for detecting suds requires at least one additional reversing switch, which increases the expense for components.

SUMMARY OF THE INVENTION

It is accordingly an object of the invention to provide an automatically controlled washing machine, which overcomes the hereinafore-mentioned disadvantages of the heretofore-known devices of this general type and which reliably detects suds without additional components.

With the foregoing and other objects in view there is provided, in accordance with the invention, in an automatically controlled washing machine including a laundry drum; a drive motor for driving the laundry drum with a plurality of different speeds for washing, rinsing and spinning; an rpm control circuit for adjusting an rpm of the drive motor; and means for determining the rpm of the drive motor in accordance with set-point and actual rpm values; the improvement comprising a control circuit of the washing machine for receiving a signal during a spin cycle, the signal being a measure for an undesired braking of the drum (for instance from suds production) and being determined by a mutual ratio of the following operating parameters of the drive motor: the set-point rpm, the actual rpm, and a load-dependent electrical variable.

In accordance with another feature of the invention, the rpm control circuit is a phase angle control circuit, and the load-dependent electrical variable is a phase angle of a supply voltage of the drive motor.

In accordance with a further feature of the invention, the rpm control circuit is a chopper control circuit, and the load-dependent electrical variable is a current takeup of the drive motor.

In the rpm control circuit of a modern washing machine, the rpm values are already available in the form of electrical variables anyway, and a load-dependent electrical variable can likewise be a value, which is present in the rpm control circuit, for the motor current or the phase angle of the motor current, so that the suds detection according to the invention requires no additional components.

In accordance with an added feature of the invention, upon application of the signal with a variable that is an indication of the presence of a quantity of suds which slows down the drum, the spin drive of the drum is controlled in such a way that it can be turned off at least for a limited length of time.

While the spin drive is off, suds can accumulate on the bottom of the tub. In accordance with an additional feature of the invention, the remaining residues of water and detergent can be pumped out by a water and detergent pump during the time that the spin drive is shut off.

In accordance with yet another feature of the invention, during the time that the spin drive is turned off, the drum can be drivable in reversing fashion in a gentle cycle. The gentle cycle is typically conducted at such low rpm that the drum motion produces no further suds and instead collapses the existing bubbles.

In accordance with yet a further feature of the invention, if there is an extensive amount of suds, after a quantity of suds that slows down the drum is ascertained, a further rinse cycle can be initiated.

Great compactness or a large quantity of suds each cause a strong braking moment at the drum, the extent of which can also be estimated from the aforementioned three parameters with fair certainty. Depending on the amount of suds ascertained in this way, one or the other provision can be initiated. In accordance with yet an added feature of the invention, in the pursuit of such provisions, when a further rinse cycle is initiated, the further rise cycle can be carried out with an increased water level.

In accordance with a concomitant feature of the invention, the control circuit includes a configuration for storing a number of spin startup attempts in memory, and for using certain frequencies of the numbers for future treatment processes to either add a number of rinse cycles corresponding to a value gained by experience to the number of rinse cycles already initially installed by a manufacturer, or to install it before a next attempt to start up a spin cycle.

Other features which are considered as characteristic for the invention are set forth in the appended claims.

Although the invention is illustrated and described herein as embodied in an automatically controlled washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
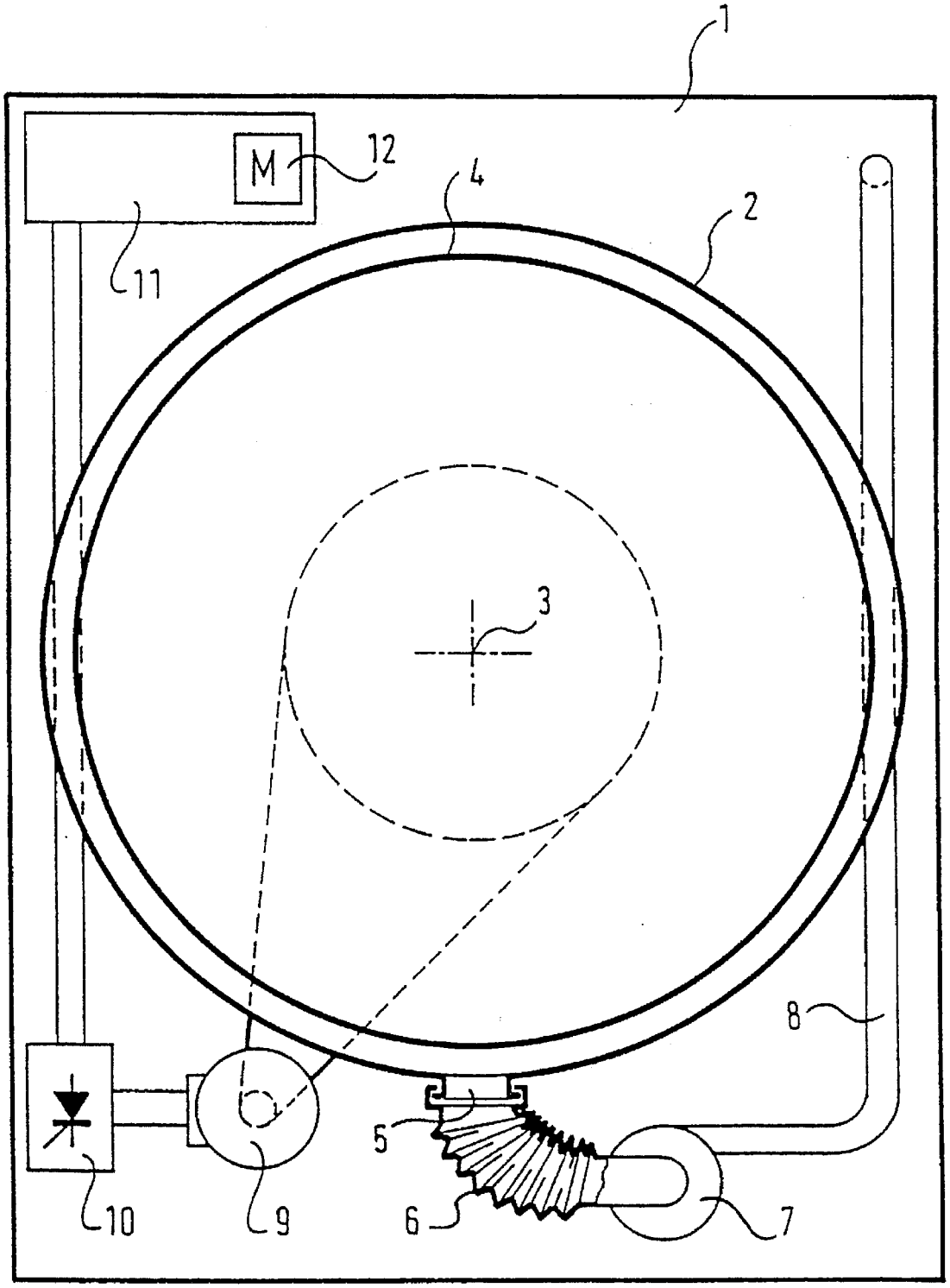
FIG. 1 is a diagrammatic view of a washing machine which has been opened to show parts that are essential to the invention described below.

Referring now to the figures of the drawing in detail and first, particularly, to FIG. 1 thereof, there is seen a cabinet-like housing 1 in which a tub 2 of a drum-type washing machine is disposed along with an inside drum 4 that is supported rotatably about a horizontal axis 3. The tub 2 has a drain opening 5 at its lowest point. A suction nozzle of a water and detergent pump 7 is connected to the drain opening 5 through a corrugated hose 6. A pressure nozzle of the water and detergent pump 7 discharges into a riser line 8 having an upper end that discharges into a non-illustrated drain hose.

The drum 4 is driven through a belt drive by a drum drive motor 9, which is electrically supplied and controlled through an rpm control circuit 10 by a control circuit 11 of the washing machine. In the example shown, the rpm control circuit 10 is constructed on the basis of a phase angle control. Instead of this kind of control, the drive motor can be regulated on the basis of a chopper control. The control circuit 11 includes at least one program stored in a memory 12. Through the use of this program, the various function elements of the washing machine can be controlled as a function of time and/or status. The memory 12 can also store the number of spin startup attempts for the drum which are made by the drive motor 9, and can keep the stored number value ready in order to influence future treatment processes.

Figure 2:
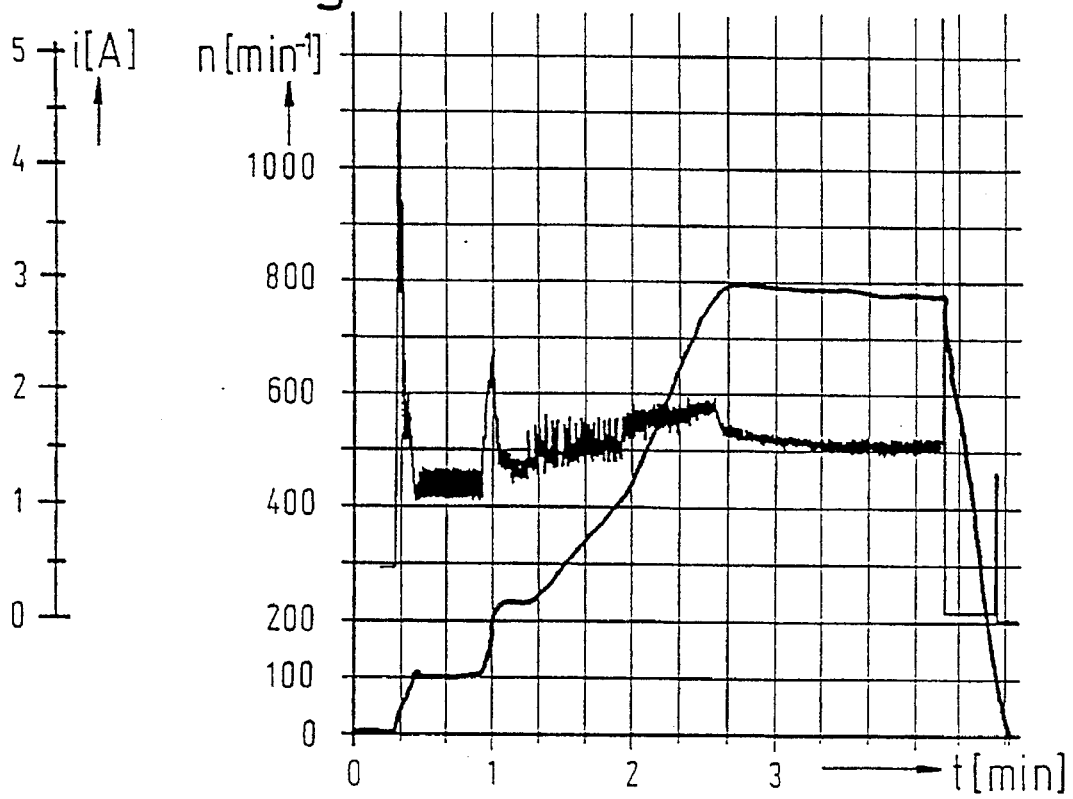
FIGS. 2 and 3 are diagrams of motor current and rpm plotted over time when the invention is not employed.
Figure 3:
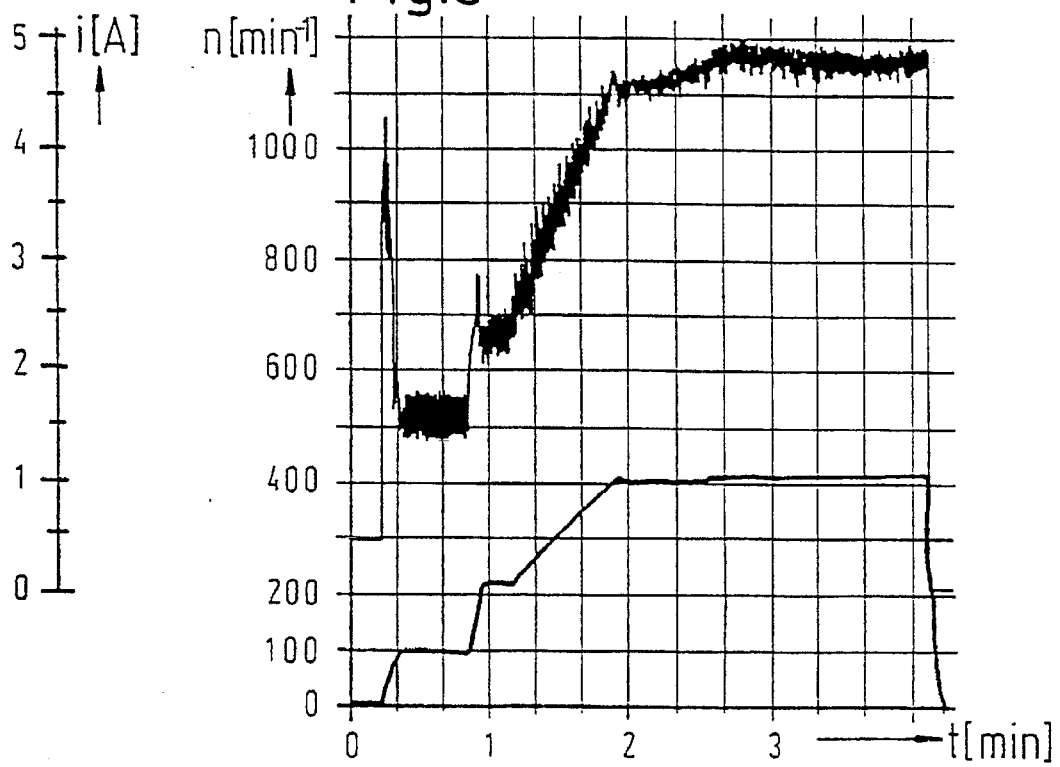

The diagrams in FIGS. 2 and 3 show the course of a motor current i over a time t and an associated drum rpm n over the time t, for a washing machine without the provisions of the invention. The phase angle is proportional to the illustrated current through the drum drive motor, and it can be taken directly as a control variable from the control circuit for the drum drive motor.

For all of the diagrams shown, the same laundry load was always tested, in a single washing machine. In the diagram of FIG. 2, the laundry load was well rinsed at the beginning of the spin cycle, and any suds-developing residual surfactant content was lacking in the water and detergent that the laundry still contained. When the drive motor is turned on and accelerated to approximately 100 rpm, a spikelike rise in the motor current up to 4.5 A can be seen, which then settles down to approximately 1.2 A. Upon further acceleration from 100 rpm to approximately 240 rpm, the spike-like rise in the motor current i is already markedly less (to approximately 2.4 A). In that case the already initiated motion of the laundry has the effect of reducing inertia. At the steady-state speed of approximately 240 rpm, the motor current drops back below 1.4 A. During a following, flatly rising ramp for the motor rpm up to approximately 800 rpm, the motor current only slowly rises above 1.5 A. When the drum rpm remains at approximately 800 rpm, the motor current drops back again to approximately 1.5 A. After a brief current peak upon turn-off, the motor current i returns to zero again, and the rpm quickly drops down to 0 rpm.

If the resting current measurement is more than 0 A, it is because in the plotting of the current diagrams the total current takeup of the washing machine was measured. However, the current takeup without the motor being turned on is only approximately 500 mA and is therefore negligible as compared with the high current takeup of the drive motor.

The laundry load which was observed in order to plot the diagram of FIG. 3 still contained suds-forming water and detergent. In principle, the current curve in the diagram during the spin startup phase until the attainment of approximately 220 rpm is approximately equivalent to that of the diagram of FIG. 2. However, since some suds must already be present between the tub and the rotating drum, the level of the current takeup during the rpm plateau at 100 rpm as well as the drop in current after the spike upon acceleration to approximately 220 rpm is already markedly higher than in the corresponding segments in FIG. 3. First, the drum is accelerated from the plateau at 220 rpm, along a ramp to approximately a time t=2 min. in the test of FIG. 3 as well, with suds that brake the drum and are evidently standing in the way of the acceleration. That is expressed in a sharp rise in motor current to somewhat above 4.5 A, which then reaches its power limit and can no longer accelerate the drum further, counter to the braking moment generated by the suds. The drum rpm therefore remains at approximately 400 rpm. That fact causes two significant disadvantages: First, the drum motor is often overly heavily loaded (for instance instead of a rated power of 300 W, there is an actual power takeup of 750 W). As result, the motor overheats and wears prematurely. Second, the laundry is often only inadequately spun dry at a reduced spin rpm. Moreover, due to the strong mechanical input into the spun-out water and detergent from the spinning drum, further suds development is intensified strongly. In other words, suds reduction is made even more difficult. Once operation is discontinued, the motor current and the drum rpm both consequently drop back to zero.

Figure 4:
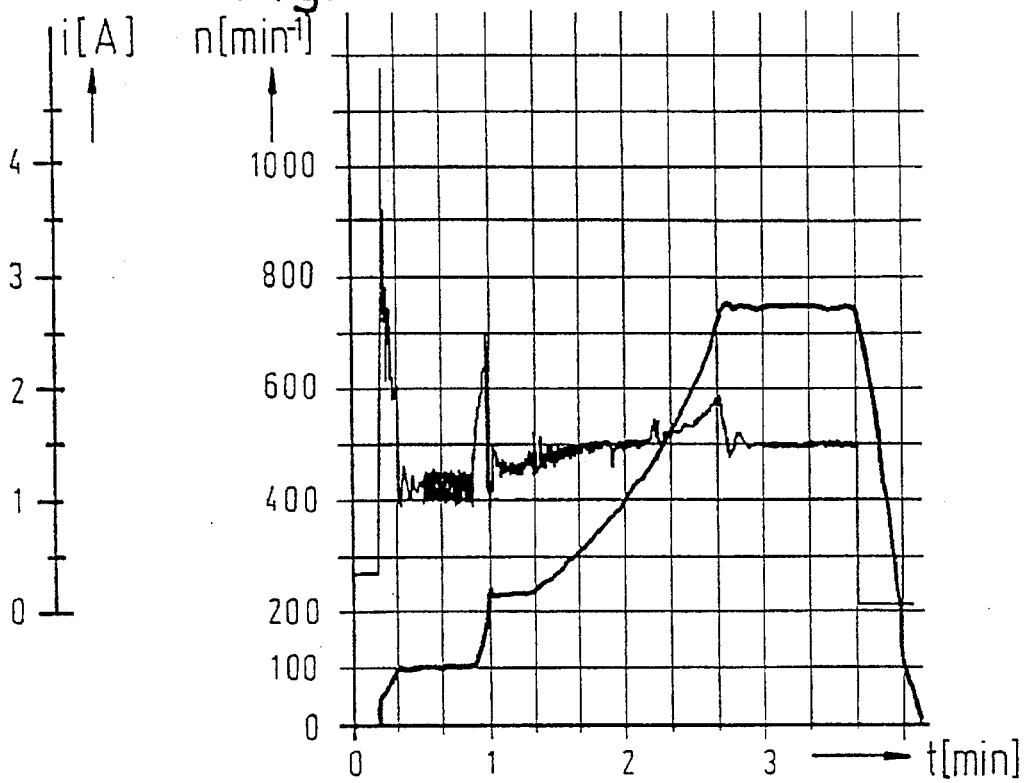
FIGS. 4 and 5 are the same diagrams when the invention is employed.
Figure 5:
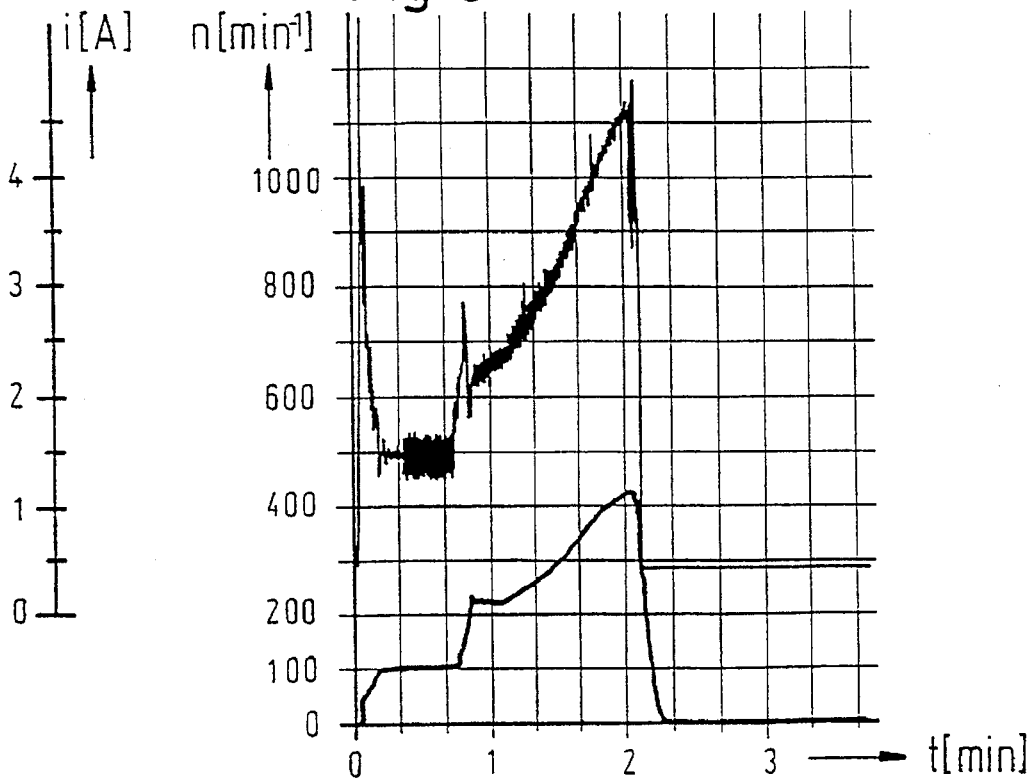

In the plottings for the diagrams of FIGS. 4 and 5, a control circuit according to the invention was used to control the drive motor. A signal can be supplied to the control circuit that is a measure of a desired braking of the drum, for instance due to suds development. It can be seen therefrom that in the attempt which is made for the diagram in FIG. 4, assuming an equal amount of laundry and otherwise identical conditions, approximately the same results are established in proportion to the applicable rpm relative to the required motor current values. An early breakdown of the rpm plateau between 700 and 800 rpm at approximately 3⅔ minutes, in contrast to somewhat more than 4 minutes in the example of FIG. 2, can be ascribed to a change of program that has nothing to do with any possible suds development.

By comparison, FIG. 5 shows that the control circuit constructed according to the invention discontinues the incipient spin cycle during the rising ramp at something above 400 rpm, because the motor current had risen far above 4.5 A, and the resultant rpm could no longer follow the intended set-point or command course shown in FIG. 4. Accordingly, this is an indication of an excessive load on the drum from external influences, for instance braking from suds. In order to monitor this undesired operating condition, the rise in the motor current itself, as is assumed in the diagrams, or the phase angle of the motor current supply as well as the proportion between the set-point or command rpm and the actual rpm, can be observed. In accordance with advantageous further features of the invention, from this discontinuation of the spin startup, a further conclusion can be drawn in the next program sequence. First, it may be important to turn off the spin drive of the drum, at least for a limited length of time. It would be advantageous to continue to operate the water and detergent pump of the washing machine during the time that the spin drive is turned off, so that water and detergent that continues to collect from collapsing suds can immediately be removed from the tub.

Water and detergent that no longer remain in the tub can no longer participate in producing further suds.

In order to also avert suds development in an ensuing spin cycle, at least one further rise cycle should be initiated after a braking quantity of suds has been detected in the tub. Such a further rinse cycle would further reduce the residual surfactant content in the water and detergent and thus decrease the danger of renewed suds development. After the conclusion of the further spin cycle, a new spin startup attempt could be made. If needed, such further spin cycles could be carried out with an increased water level.

Figure 6:
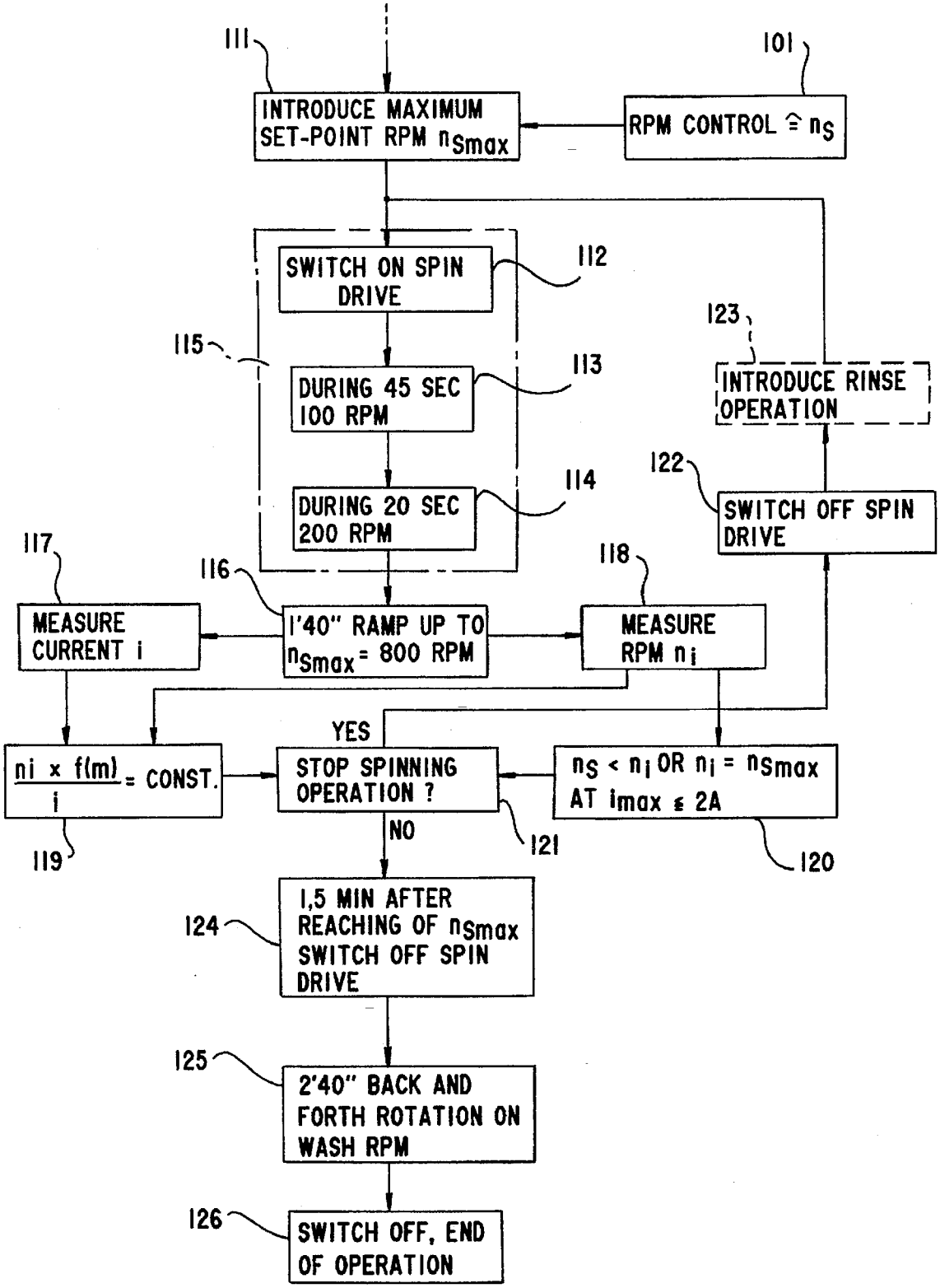
FIG. 6 is a flowchart of a preferred operational embodiment.

Referring now to the flowchart of FIG. 6, we presume therein that the control circuit of the washing machine receives signals from sensors and transducers regarding the angular speed n (rpm) and the motor current i (ampere); the control circuit is further provided with input means for entering the maximum values for the spin-cycle setpoint speed $n_{Smax}$ and a comparator or comparison means for comparing the current setpoint and actual speed values ns $n_s$ $n_i$; also, the control circuit has computation means which calculate a ratio or a relationship of the respectively achieved actual speeds $n_i$ relative to the currently flowing motor current i.

The spinning drive is turned on after the maximum desired spin-cycle setpoint speed $n_{Smax}$ has been manually input and after a wash and rinse cycle has just ended. The control circuit is thereby based on a spinning program as it is illustrated by the speed diagram curves of FIGS. 2 and 4.

The exemplary embodiment of FIG. 6 is proceeds as follows:

All of the processes are performed fully automatically with the exception of inputting the maximum setpoint speed at 111. It should be noted, however, that it is also possible to set the maximum spin speed so that no such entry is necessary. The parameter of setpoint spin speed can be processed in a programming sequence equally, whether it is a manually input speed, a speed selected from several preset options or a fully predefined speed.

After the preceeding rinse process has been ended, the value for the maximum setpoint spin speed $n_{Smax}$ is introduced into the processing algorithm and the spin drive is turned on; steps 111 and 112. The spin drive is regulated in accordance with the underlying spin program by the speed control 101 and it is thereby operated for example for 45 seconds at 100 rpm (as measured at the laundry drum 4), and then for 20 seconds at 200 rpm (114). That distribution has been found to lead to particularly suitable conditions regarding fast and even laundry distribution within the drum. The speed 100 rpm thereby lies just above the speed at which the laundry comes to lie on the drum walls due to the centrifugal (i.e. centripetal) forces. The speed 200 rpm lies just above the speed at which the entire, swingingly suspended sud container assembly is in its resonant state. These foregoing steps in the spin introduction phase are not influenced externally and they always proceed in the same manner; accordingly, the three blocks 112–114 are combined in a dash-dotted frame 115.

Following the spin entry phase, the laundry drum 4 is accelerated to $n_{Smax}$=800 rpm within a ramp of 1 min 20 sec (step 116). Values for the motor current I and the actual speed $n_i$ are simultaneously measured within short intervals during the acceleration phase (117, 118) and they are further processed.

The further processing includes the formation of a ratio between the actual speed values and the motor current (119), on the one hand, and a ration between the actual speed and the setpoint speed, on the other hand (120).

When the results of one of the two further processing blocks 119 and 120 are negative, then the spin cycle is terminated at 121 and the spin drive is stopped for a brief time at 122. The pump continues to operate for the purpose of removing detergent solution from the container which runs off from the suds mass. In addition—if it is deemed necessary—it is possible to add an additional spin cycle at 123. The full spinning process then starts anew when the spin drive is again turned on at 112.

When the results of both further processing blocks 119 and 120 are positive, however, then the spinning process is continued at 121. This means that the ramp 116 is further traversed when the maximum spin setpoint speed $n_{Smax}$ (e.g. 800 rpm) had not been reached, or the spinning process is continued at 124 by maintaining the maximum spin setpoint speed $n_{Smax}$ (e.g. 800 rpm) for a preprogrammed period of time (e.g. 1'30") after the speed $n_{Smax}$ had been reached. The spinning process is ended with a subsequent reversing phase at 125, in which the drum is repeatedly driven backwards and forward at washing speed. This causes the laundry to peel from the drum wall and it serves to loosen the laundry. The reversing phase may last about 2'40"and it ends when the spin drive is stopped at 126.

Returning now to the further processing blocks:

The first block 119 calculates a value from the ratio of the measured actual speed $n_i$ over the measured current i. The ratio is multiplied by a factor f(m), which represents a mostly empirically determined function of several machine-dependent data parameters, such as motor specifications, drive and transmission parameters, and data concerning the moving mass. The data are constant for any given machine. When the spinning process runs regularly and without any external braking of the drum, then the calculated value must be constant at each point of the ramp. When the calculated value, however, deviates from the standard value by more than an allowable tolerance, then the spinning process must be interrupted. These are steps 121 and 122; and possibly 123).

The second block 120 works simultaneously with the first block 119. A ratio is formed from the instantaneous value of the actual speed $n_i$ and the setpoint speed $n_s$, which should be present at that moment of the ramp. When the operation proceeds properly, that ratio should have the value 1. A slight deviation, of course, may be tolerated. If the actual speed $n_i$, however, is substantially smaller than the setpoint speed $n_s$ (i.e. by a smaller factor than 1), then the spinning process must also be interrupted.

A further specific case must be taken into account: When the actual speed has reached the maximum spin setpoint $n_{Smax}$ the end of the ramp, yet the motor current i is greater than, say, 2 ampere, then the spinning process must be terminated as well.

All three foregoing cases necessarily lead to the termination of the spinning process. The spinning process is then restarted after a given rest time. It can thereby be safely assumed that all three cases are caused by extraneous suds foam production in the laundry container.

Of special value for convenient operation of the washing machine, in which braking by detergent suds could be taken into account from the very outset, would be a configuration in the control circuit that stores in memory the number of spin startup attempts that had been broken off upon suds development and that from certain frequencies of such numbers for future treatment processes from the outset adds a number of spin cycles, corresponding to the value attained by experience, to the number of spin cycles already installed by the manufacturer. However, it would be advantageous in this connection if after a fixed number of treatment processes, an attempt would be made by using the manufacturer-installed number of rinse cycles, to test whether or not the human operator has changed his or her mode of operation, for instance by a change of detergent. As an alternative, however, the control circuit may be constructed for this purpose in such a way that in principle the already manufacturer-installed number of spin cycles and one spin startup attempt are made, but then this first startup attempt is followed by a number of rinse cycles, corresponding to the value gained by experience, before the next attempt is made to startup a spin cycle.

We claim:

1. In an automatically controlled washing machine including:

a laundry drum;

a drive motor for driving the laundry drum with a plurality of different speeds for washing, rinsing and spinning;

an rpm control circuit for adjusting an rpm of the drive motor; and means for determining the rpm of the drive motor in accordance with set-point and actual rpm values; the improvement comprising:

a control circuit receiving a signal during a spin cycle, the signal being a measure for an undesired braking of the drum and being determined by a mutual ratio of the following operating parameters of the drive motor:

a) the set-point rpm, b) the actual rpm, and c) a load-dependent electrical variable;

and said control circuit controlling a spinning operation of the washing machine in dependence on the signal.

2. The washing machine according to claim 1, wherein the rpm control circuit is a phase angle control circuit, and the load-dependent electrical variable is a phase angle of a supply voltage of the drive motor.

3. The washing machine according to claim 1, wherein the rpm control circuit is a chopper control circuit, and the load-dependent electrical variable is a current takeup of the drive motor.

4. The washing machine according to claim 1, including means for turning off a spin drive of the drum at least for a limited length of time, upon application of the signal with a variable being an indication of a presence of a quantity of suds slowing down the drum.

5. The washing machine according to claim 4, including a water and detergent pump, and means for continuing to drive said water and detergent pump during the period when the spin drive is turned off.

6. The washing machine according to claim 4, including means for driving the drum in reverse in a gentle cycle during the time that the spin drive is turned off.

7. The washing machine according to claim 1, including means for initiating at least one further rinse cycle after a quantity of suds that slows down the drum is ascertained.

8. The washing machine according to claim 7, including means for conducting at least one of the rinse cycle and further rinse cycle with an elevated water level.

9. The washing machine according to claim 7, wherein said control circuit includes a configuration for storing a number of spin startup attempts in memory, and for using certain frequencies of the numbers for future treatment processes to either add a number of rinse cycles corresponding to a value gained by experience to the number of rinse cycles already initially installed by a manufacturer, or to install it before a next attempt to start up a spin cycle.

10. An automatically controlled washing machine, comprising:

a laundry drum, and a drive motor driving the laundry drum with a plurality of different speeds for washing, rinsing and spinning;

an rpm control circuit for adjusting a speed of the drive motor; said control circuit receiving signals representing an actual speed of the laundry drum, and said control circuit being programmed to control the speed of the drive motor during a spin cycle in dependence on a signal formed from the following parameters:

a) a set-point speed, b) an actual speed, and c) a load-dependent variable;

wherein the signal is a ratio of the parameters and the signal is a measure for an undesired braking of the drum.

* * * * *